United States Patent [19]

Heitmann

[11] Patent Number: 4,564,028

[45] Date of Patent: Jan. 14, 1986

[54] APPARATUS FOR MAKING A TOBACCO FILLER

[75] Inventor: Uwe Heitmann, Hamburg, Fed. Rep. of Germany

[73] Assignee: Hauni-Werke Körber & Co. KG, Hamburg, Fed. Rep. of Germany

[21] Appl. No.: 590,204

[22] Filed: Mar. 16, 1984

[30] Foreign Application Priority Data

Mar. 19, 1983 [DE] Fed. Rep. of Germany ..... 3310035

[51] Int. Cl.[4] ..... A24C 5/18; A24C 5/31

[52] U.S. Cl. ..... 131/84.4

[58] Field of Search ..... 131/84 B, 84 R, 84 C, 131/84.4, 84.1, 84.2, 84.3

[56] References Cited

U.S. PATENT DOCUMENTS 3,261,366 7/1966 Richter et al. ..... 131/84.4
4,280,516 7/1981 Reuland ..... 131/84.4
4,304,243 12/1981 Seragnoli ..... 131/84 C

FOREIGN PATENT DOCUMENTS 0919150 2/1963 United Kingdom ..... 131/84 R

*Primary Examiner*—Millin V.
*Assistant Examiner*—H. Macey
*Attorney, Agent, or Firm*—Peter K. Kontler

[57] ABSTRACT

A cigarette rod making machine wherein the trimming device is movable toward or away from the suction conveyor on which the tobacco stream is formed so as to remove larger or smaller quantities of excess tobacco and to thereby influence the density of the resulting filler. The sidewalls of the tobacco channel which confines the tobacco stream on the suction conveyor have portions which are immediately adjacent to the trimming device and are movable therewith relative to the suction conveyor so that the positions of such portions of the sidewalls relative to the trimming device remain unchanged in all positions of the trimming device. The disc-shaped members establish a boundary between the excess of tobacco and the tobacco which is to form the filler, and the excess is removed by a rotary brush.

10 Claims, 2 Drawing Figures

APPARATUS FOR MAKING A TOBACCO FILLER

BACKGROUND OF THE INVENTION

The present invention relates to tobacco processing machines in general, and more particularly to improvements in apparatus which can be used in such machines to make rod-like tobacco fillers.

Cigarette making machines are equipped with means for forming a continuous stream of tobacco particles and with means, known as a trimming or equalizing device, for removing the surplus or excess from the stream so that the remainder of the stream forms a rod-like filler which is ready to be compacted and wrapped into a web of cigarette paper or the like. The resulting cigarette rod is thereupon severed at regular intervals to yield a file of plain cigarettes of unit length or multiple unit length. The thus obtained cigarettes are transported into storage, to a filter tipping machine or directly to a packing machine.

Many presently known cigarette rod making machines employ a tobacco stream forming unit wherein particles of tobacco are showered into elongated tobacco channel having an elongated bottom wall constituting one reach of an endless flexible air-permeable conveyor which gathers the particles into a continuous stream and transports the resulting stream lengthwise between two stationary sidewalls of the channel. That side of the bottom wall which faces away from the sidewalls is adjacent to a suction chamber serving to attract the stream to the bottom wall and to ensure that the particles of the stream advance with the bottom wall in a direction toward the wrapping station. The excess is removed by a trimming device which is normally mounted for movement toward and away from the bottom wall so as to remove from the stream a variable amount of tobacco with the result that the remainder of the stream forms a continuous rod-like filler containing a desired quantity of tobacco per unit length. The just described apparatus can be used for the making of fillers from natural or reconstituted tobacco as well as from substitute materials in admixture to or without natural tobacco. The articles which are produced can constitute plain cigarettes, cigars or cigarillos.

As a rule, the position of the trimming device with reference to the bottom wall of the tobacco channel is varied in dependency on one or more variable parameters, such as the density of the filler. Reference may be had, for example, to commonly owned U.S. Pat. No. 4,280,516 granted July 28, 1981 to Joachim Reuland. Such mode of regulating the quantity of tobacco in the filler is quite acceptable because the density of the filler can be changed with a minimum of delay. However, it has been found that the weight of finished products (such as plain cigarettes of unit length) fluctuates considerably as a result of changes in the position of the trimming device in response to signals from a density monitoring device. The fluctuations are especially pronounced when the trimming device is moved to a position at a substantial distance from the bottom wall of the tobacco channel, i.e., to a position in which the rate of removal of the excess from the continuous tobacco stream is minimal. In other words, the unpredictability of characteristics of the ultimate product is more pronounced when the trimming device is moved to a position in which it removes a relatively small quantity of tobacco particles. Moreover, the fluctuations are more pronounced when the extent of adjustment of the trimming device is substantial, e.g., when the tobacco engaging and removing components of the trimming device are moved from positions very close or rather close to the bottom wall to positions at a much greater distance from such bottom wall.

OBJECTS AND SUMMARY OF THE INVENTION

An object of the invention is to provide a novel and improved apparatus for removing the surplus from a continuous stream of tobacco particles in such a way that the changes in the rate of removal will not adversely influence the characteristics of the ultimate products.

Another object of the invention is to provide an apparatus which ensures that the weight of plain cigarettes, cigars or cigarillos is not affected by necessary changes in the position of the trimming device with respect to the stream building means of a cigarette rod making or like machine.

A further object of the invention is to provide a novel and improved tobacco channel for use in a cigarette rod making machine.

An additional object of the invention is to provide an apparatus which can be installed in existing cigarette rod making and like machines as a superior substitute for heretofore known filler forming apparatus.

Still another object of the invention is to provide an apparatus which ensures predictable removal of tobacco particles from an unequalized tobacco stream irrespective of the position of the excess removing means with reference to the tobacco channel.

An additional object of the invention is to provide a tobacco processing machine which embodies the above outlined apparatus.

The invention is embodied in an apparatus for converting a stream of tobacco particles into a rod-like filler. The apparatus comprises an elongated tobacco channel serving to receive particles (e.g., shreds) of tobacco which form therein a continuous stream containing particles in excess of the quantity required in the filler and including a foraminous bottom wall or first wall which is driven to move lengthwise of the channel and has a first side facing the stream and a second side facing away from the stream. The tobacco channel further includes first and second sidewalls which extend from the first side of the bottom wall, and the apparatus further comprises a suction chamber which is adjacent to the second side of the bottom wall and serves to attract the particles of the stream to the first side, and a trimming or equalizing device which is spaced apart from the first side of the bottom wall and serves to remove the excess from successive increments of the moving tobacco stream in the channel. The sidewalls have portions which are adjacent to the trimming device and the apparatus further comprises means for jointly moving the trimming device and the portions of the sidewalls toward and away from the bottom wall. The sidewalls (or at least the aforementioned portions of the sidewalls) are or can be parallel to each other.

The trimming device can comprise at least substantially coplanar first and second discs rotatable about axes which are outwardly adjacent to the respective sidewalls and having portions which extend into the channel so as to engage the particles of tobacco in a plane that constitutes the boundary between the particles which are to form the filler and the excess.

The apparatus further comprises drive means (such as a reversible electric motor) for the moving means. Such drive means can cause the moving means to move the trimming device and the portions of the sidewalls toward or away from the bottom wall of the channel in such a way that the positions of the portions of sidewalls with reference to the trimming device remain unchanged. The portions of the first and second sidewalls are preferably formed with end faces which are closely adjacent to the respective disc-shaped members of the trimming device.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
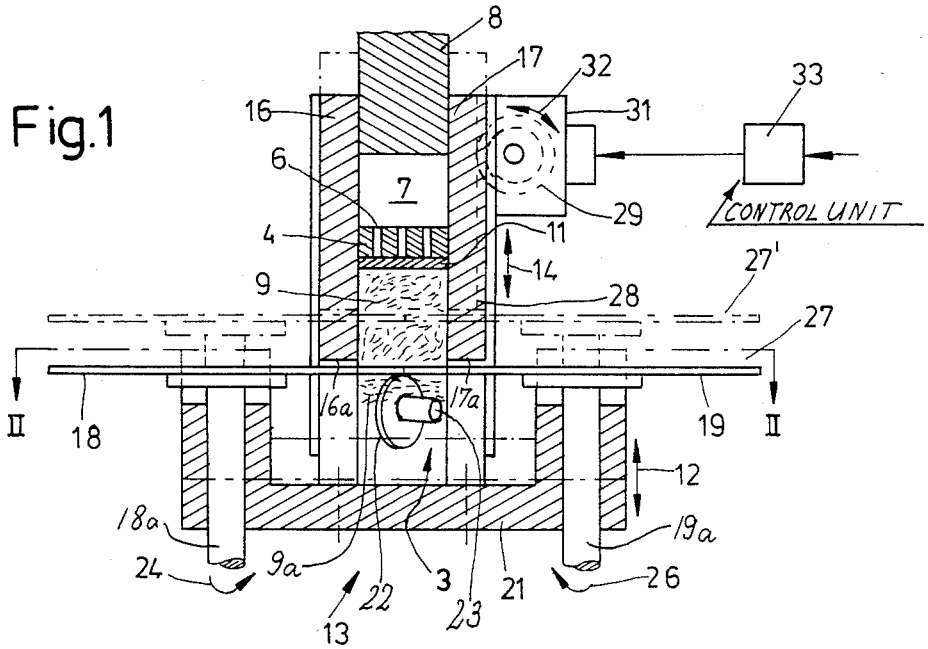
FIG. 1 is a transverse vertical sectional view of an apparatus which embodies the invention.

The drawing shows an apparatus which is installed in a cigarette rod making machine (e.g., a machine known as PROTOS which is manufactured and sold by the assignee of the present application) and comprises an elongated tobacco channel 3 including two spaced-apart parallel sidewalls 1 and 2 and an elongated bottom wall 11 which is the elongated lower reach of an endless air-permeable belt conveyor serving to advance a continuous tobacco stream 9 in the direction of arrow A. The underside of the lower reach 11 is adjacent to the stream 9 and the upper side of such reach is adjacent to and moves along a perforated bottom wall 4 forming part of a stationary suction chamber 7 which attracts the tobacco stream 9 to the underside of the lower reach 11. The bottom wall 4 has holes 6 which enable the suction chamber 7 to establish a pressure differential between the opposite sides of the lower reach 11 for the purpose of attracting the stream 9. The manner in which the air-permeable conveyor including the lower reach 11 is trained over pulleys is well known in the art and need not be described here (reference may be had, for example, to the aforementioned U.S. Pat. No. 4,280,516). The same holds true for the manner in which one of the pulleys is driven so as to induce the conveyor to advance the stream 9 in the direction of arrow A. The suction chamber 7 is connected to the intake of a blower or another suitable suction generating device, not shown. The reference character 8 denotes in FIG. 1 a stationary part which cooperates with the perforated bottom 4 to define the suction chamber 7.

Figure 2:
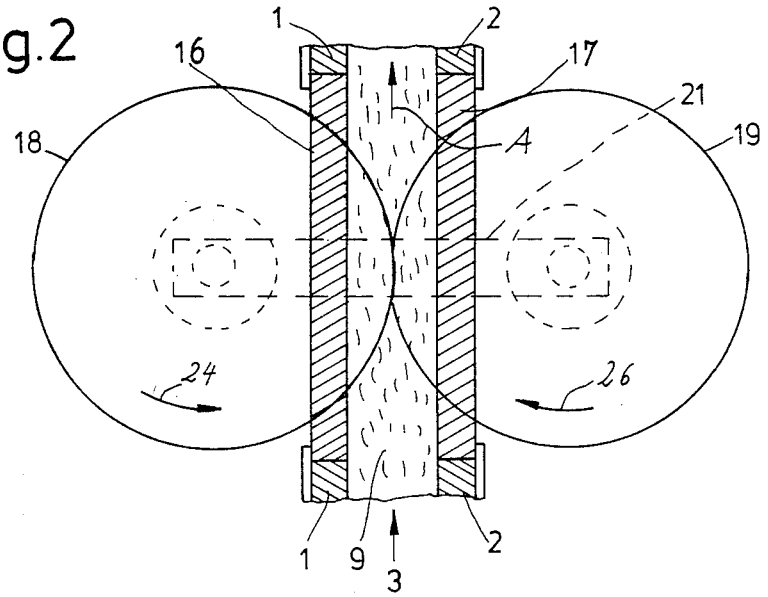
FIG. 2 is a horizontal sectional view as seen in the direction of arrows from the line II—II of FIG. 1.

The apparatus further comprises a trimming or equalizing device 13 which is disposed at a level below the lower reach 11 of the air-permeable conveyor and is movable up and down, i.e., at right angles to the path of movement of the stream 9, so as to remove the excess of tobacco particles and to thus convert the stream 9 into a rod-like filler which is ready for wrapping into a web of cigarette paper or the like, for example, in a manner as shown schematically in the aforementioned U.S. Pat. No. 4,280,516. The directions in which the trimming device 13 is adjustable relative to the lower reach 11 of the air-permeable conveyor are indicated by a double-headed arrow 14. In accordance with a feature of the present invention, the trimming device 13 is mounted on a substantially U-shaped moving means or carrier 21 and such carrier further supports two movable portions 16, 17 of the sidewalls 1 and 2, respectively. As can be readily seen in FIG. 2, the sidewall 1 has two stationary portions which flank the vertically movable portion 16, and the sidewall 2 has two stationary portions which flank the vertically movable portion 17. Mounting of the sidewall portions 16, 17 on the carrier 21 ensures that the positions of such portions with reference to the trimming device 13 remain unchanged irrespective of the position of the trimming device relative to the lower reach 11 of the air-permeable conveyor for the tobacco stream 9.

The illustrated trimming device 13 comprises two coplanar substantially disc-shaped members 18, 19 which are mounted on and rotated by shafts **18*a*, 19*a* located at the outer sides of the respective sidewalls 1 and 2. The shafts 18*a*, 19*a* are journalled in the carrier 21. The purpose of those portions of the disc-shaped members 18, 19 which extend inwardly beyond the respective sidewalls 1 and 2 is to pinch the particles of the stream 9 in the trimming plane and to thus determine the extent of removal of surplus or excess 9*a* by a rotary brush 22 which is driven by a shaft 23 and is located at a level below the common plane of the disc-shaped members 18, 19. The shaft 23 is also journalled in or otherwise supported by the carrier 21. This shaft can be rotated by a discrete motor or by the motor which drives the disc-shaped members 18, 19 in directions respectively indicated by the arrows 24 and 26**.

The trimming device 13 is movable up and down (arrows 12 and 14) between two end positions in which the disc-shaped members 18, 19 are respectively located in a first plane 27 (as shown in FIG. 1 by solid lines) and a second plane (indicated in FIG. 1 by phantom lines, as at 27'). All such up and down movements of the trimming device 13 are shared by the portions 16, 17 of the sidewalls 1 and 2 because such portions are mounted on the carrier 21, the same as the disc-shaped members 18, 19 and brush 22 of the trimming device 13. It is clear that the trimming device 13 can also assume a practically infinite number of intermediate positions in which the common plane of the disc-shaped members 18, 19 is located somewhere between the planes 27 and 27'.

The drive means for the carrier 21 of the sidewall portions 16, 17 and trimming device 13 comprises a reversible electric motor 31 for a pinion 29 in mesh with a vertical toothed rack 28 affixed to the carrier 21. The double-headed arrow 32 denotes the directions in which the pinion 29 can be driven by the servomotor 31 in response to appropriate signals transmitted by a control unit 33 which, in turn, can receive signals from a density monitoring device such as the density monitoring device 23, 24 shown in FIG. 1 of the aforementioned U.S. Pat. No. 4,280,516. In the illustrated embodiment, the rack 28 is affixed to or made integral with the movable portion 17 of the sidewall 2. However, it is equally possible to connect the rack 28 to the movable portion 16 if the servomotor 31 is disposed at the outer side of the sidewall 1. Moreover, it is possible to employ other types of drive means for the carrier 21, e.g., a fluid-operated cylinder and piston unit.

The movable portions 16, 17 of the sidewalls 1 and 2 have lower edge faces or end faces 16*a*, 17*a* which are immediately or closely adjacent to the upper sides of the respective disc-shaped members 18 and 19. The distance between the members 18, 19 and the end faces 16', 17' remains unchanged irrespective of the selected level of the carrier 21. This ensures that the particles of the stream 9 are properly confined in the channel 3 regardless of the selected position of the carrier 21 and trimming device 13. Consequently, the rate of removal of tobacco is determined solely by the level of the trimming device 13 and not by increased or reduced gaps between the trimming device and the sidewalls of the tobacco channel as in heretofore known filler forming apparatus.

It is also within the purview of the invention to provide a discrete support or carrier for the portions 16, 17 of the sidewalls 1 and 2, to use the carrier 21 solely as a support for the trimming device 13, to provide a second drive for the discrete carrier, and to provide means for synchronizing the movements of the two carriers in order to avoid movements of the sidewall portions 16, 17 relative to the trimming device 13 and/or vice versa. The illustrated apparatus is preferred at this time because it employs a single drive means and need not be provided with discrete synchronizing means.

It will be noted that the upper parts of the sidewall portions 16 and 17 extend well above the level of the lower reach 11 of the air-permeable conveyor. This ensures that the particles of tobacco cannot escape along the upper edge faces of the portions 16, 17 irrespective of the selected level of the trimming device 13 and of the portions 16 and 17. In other words, the range of adjustment of the trimming device 13 relative to the suction chamber 7 is less than the extent to which the portions 16, 17 of the sidewalls 1, 2 extend upwardly and above the lower reach 11 of the air-permeable conveyor.

The trimming device 13 constitutes but one form of means for removing the excess from the tobacco stream 9. For example, the apparatus can employ a trimming device of the type disclosed in commonly owned U.S. Pat. No. 3,261,366 granted July 19, 1966 to Willy Richter et al., in commonly owned copending U.S. patent application Ser. No. 483,371 filed Apr. 8, 1983, now U.S. Pat. No. 4,538,626, by Alfred Hinzmann, or any other suitable trimming device which can remove larger or smaller quantities of surplus tobacco by moving its carrier toward and away from the conveyor for the tobacco stream.

An important advantage of the improved apparatus is that the tobacco stream portion which is in the process of being trimmed or equalized is adequately guided all the way from the air-permeable conveyor to the plane of the disc-shaped members 16, 17 irrespective of the selected distance between the suction chamber 7 and the carrier 21. In other words, the particles of tobacco in the region of the material removing station are guided with the same degree of accuracy irrespective of whether the trimming device 13 removes a larger or a smaller percentage of tobacco which forms the stream 9. The feature that the distance between the edge faces 16', 17' of the sidewall portions 16, 17 and the plane of the disc-shaped member 18, 19 remains unchanged irrespective of the selected level of the carrier 21 ensures that the particles of tobacco cannot escape from the channel 3 laterally between the sidewalls 1, 2 and the disc-shaped members 17 and 18, i.e., any and all surplus which is to be removed must be removed by the rotary brush 22 of the trimming device 13. It has been found that the improved apparatus greatly reduces the likelihood of fluctuations of the weight of finished rod-shaped articles merely because the trimming device 13 is moved to a position at a selected distance from the suction chamber 7. In other words, the weight of tobacco-containing rod-shaped articles will or can be changed when the trimming device 13 is moved to a different level; however, once the trimming device 13 is properly positioned at the newly selected level, the weight of the articles remains unchanged for long periods of time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a stream of tobacco particles into a filler, comprising an elongated tobacco channel arranged to receive particles of tobacco which form therein a continuous stream containing particles in excess of the quantity required in the filler and including a foraminous first wall arranged to move lengthwise of the channel and having a first side and a second side, said channel further including spaced-apart first and second sidewalls extending from the first side of said first wall; a suction chamber adjacent to the second side of said first wall to attract the particles of the stream to said first side; a trimming device spaced apart from the first side of said first wall and arranged to remove the excess from the tobacco stream in said channel, said sidewalls having portions adjacent to said trimming device; and means for jointly moving said trimming device and said portions of said sidewalls toward and away from said first wall.

2. The apparatus of claim 1, wherein said sidewalls are parallel to one another.

3. The apparatus of claim 1, wherein said trimming device includes at least substantially coplanar first and second discs rotatable about axes which are outwardly adjacent to the respective sidewalls and having portions extending into said channel.

4. The apparatus of claim 1, further comprising drive means for said moving means.

5. The apparatus of claim 1, wherein said moving means comprises a carrier for said trimming device and said portions of said sidewalls are affixed to said carrier.

6. In a cigarette maker, the combination of a conveyor having an elongated portion arranged to transport a continuous stream of tobacco particles so that an exposed side of the stream faces away from said portion; a trimming device adjacent to such side of the tobacco stream and movable toward and away from said portion to thereby respectively remove larger and smaller quantities of tobacco particles at the exposed side of the stream; spaced apart first and second wall portions flanking the stream in the region of said trimming device; and means for moving said trimming device and said wall portions relative to said conveyor so that the positions of said wall portions with reference to said trimming device remain unchanged.

7. The combination of claim 6, wherein said trimming device comprises coplanar first and second rotary tobacco engaging discs and said first and second wall portions have end faces closely adjacent to the respective discs.

8. The combination of claim 7, wherein said portion of said conveyor is disposed in a plane which is spaced apart from and parallel to the common plane of said discs.

9. The combination of claim 6, wherein said portion of said conveyor is permeable to air and further comprising means for establishing a pressure differential between that side of the conveyor portion which faces away from and the side which is contacted by the tobacco stream so as to urge the tobacco stream against the conveyor.

10. The combination of claim 6, further comprising reversible motor means for said moving means.

* * * * *